US006874328B2

(12) United States Patent
Suzuki et al.

(10) Patent No.: US 6,874,328 B2
(45) Date of Patent: Apr. 5, 2005

(54) HYBRID COMPRESSOR DEVICE

(75) Inventors: Yasushi Suzuki, Chiryu (JP); Shigeki Iwanami, Okazaki (JP); Hironori Asa, Okazaki (JP); Keiichi Uno, Kariya (JP)

(73) Assignees: Nippon Soken Inc., Nishio (JP); Denso Corporation, Kariya (JP)

( * ) Notice: Subject to any disclaimer, the term of this patent is extended or adjusted under 35 U.S.C. 154(b) by 0 days.

(21) Appl. No.: 10/784,241

(22) Filed: Feb. 24, 2004

(65) Prior Publication Data

US 2004/0163400 A1 Aug. 26, 2004

Related U.S. Application Data

(62) Division of application No. 10/305,010, filed on Nov. 27, 2002, now Pat. No. 6,742,350.

(30) Foreign Application Priority Data

| | | |
|---|---|---|
| Nov. 30, 2001 | (JP) | 2001-366706 |
| Jul. 4, 2002 | (JP) | 2002-196053 |
| Jul. 31, 2002 | (JP) | 2002-223638 |
| Sep. 27, 2002 | (JP) | 2002-284142 |

(51) Int. Cl.[7] ..... F25B 41/00; F25B 27/00

(52) U.S. Cl. ..... 62/193; 62/236; 62/323.3; 62/323.4; 62/470; 417/223; 417/374

(58) Field of Search ..... 62/236, 193, 470, 62/133, 230, 228.4, 243, 323.4, 323.3; 417/223, 228, 281, 374

(56) References Cited

U.S. PATENT DOCUMENTS

| | | | | |
|---|---|---|---|---|
| 5,492,189 A | | 2/1996 | Kriegler et al. | |
| 5,867,996 A | | 2/1999 | Takano et al. | |
| 6,230,507 B1 | | 5/2001 | Ban et al. | |
| 6,234,769 B1 | | 5/2001 | Sakai et al. | |
| 6,351,957 B2 | | 3/2002 | Hara | |
| 6,375,436 B1 | | 4/2002 | Irie et al. | |
| 6,443,712 B2 | | 9/2002 | Sakai et al. | |
| 6,501,190 B1 | | 12/2002 | Seguchi et al. | |
| 6,543,243 B2 | | 4/2003 | Mohrmann et al. | |
| 6,733,251 B2 | * | 5/2004 | Sakurabayashi et al. | 417/360 |
| 2003/0013343 A1 | * | 1/2003 | Abe et al. | 439/587 |
| 2003/0118450 A1 | | 6/2003 | Iwanami et al. | |
| 2003/0136138 A1 | | 7/2003 | Tsuboi et al. | |
| 2004/0191083 A1 | * | 9/2004 | Gennami et al. | 417/310 |
| 2004/0202550 A1 | * | 10/2004 | Kawaguchi et al. | 417/212 |

FOREIGN PATENT DOCUMENTS

| | | |
|---|---|---|
| JP | A-2000-278810 | 10/2000 |

* cited by examiner

*Primary Examiner*—Marc Norman
(74) *Attorney, Agent, or Firm*—Posz & Bethards, PLC

(57) ABSTRACT

In a hybrid compressor for a vehicle where a vehicle engine is stopped when the vehicle is temporally stopped, a pulley, a motor and a compressor can be driven in independent from each other, and are connected to a sun gear, planetary carriers and a ring gear of a planetary gear. A rotational speed of the motor is adjusted by a controller, so that a rotational speed of the compressor is changed with respect to a rotational speed of the pulley. Accordingly, production cost of the hybrid compressor and the size thereof can be reduced, while a cooling function can be ensured even when the vehicle engine is stopped.

9 Claims, 12 Drawing Sheets

HYBRID COMPRESSOR DEVICE

CROSS-REFERENCE TO RELATED APPLICATION

This application is a divisional application of U.S. patent application Ser. No. 10/305,010, file on Nov. 27, 2002 now U.S. Pat. No. 6,742,350 which is related to and claims priority from Japanese Patent Applications No. 2001-366706 filed on Nov. 30, 2001, No. 2002-196053 filed on Jul. 4, 2002, No. 2002 -223638 filed on Jul. 31, 2002, and No. 2002-284142 filed on Sep. 27, 2002, the contents of which are hereby incorporated by reference.

BACKGROUND OF THE INVENTION

1. Field of the Invention

The present invention relates to a hybrid compressor device suitable for a refrigerant cycle system mounted in an idling stop vehicle, where a vehicle engine is stopped when the vehicle is temporally stopped.

2. Description of Related Art

Recently, the market for an idling stop vehicle has been increased to save fuel consumption. In a case where a compressor is driven only by an engine of the vehicle, when the vehicle is temporarily stopped, its engine is stopped, so that the compressor, driven by the engine, is also stopped in a refrigerant cycle system. In order to overcome this problem, in a conventional hybrid compressor device disclosed in JP-A-2000-130323 (corresponding to U.S. Pat. No. 6,375,436), driving force of the engine is transmitted to a pulley through a solenoid clutch, and one end of a rotational shaft of the compressor is connected to the pulley. Further, the other end of the rotational shaft of the compressor is connected to a motor. Accordingly, when the engine is stopped, the solenoid clutch is turned off, and the compressor is driven by the motor, so that the refrigerant cycle system can be operated regardless of the operation of the engine.

However, the hybrid compressor device requires the solenoid clutch for switching a driving source of the compressor between the engine in the operation of the engine, and the motor in the stop of the engine. Therefore, production cost of the hybrid compressor device is increased. Further, the compressor is operated by one of both the driving sources of the engine and the motor. Therefore, a discharge capacity of the compressor and a size thereof are need to be set based on a maximum heat load of the refrigerant cycle system in a driving force range of each driving source. For example, when a cool down mode (quickly cooling mode) is selected directly after the start of the vehicle in the summer, the heat load of the compressor becomes in maximum. Thus, the discharge capacity of the compressor and the size thereof are set so as to satisfy the maximum heat load, thereby increasing the size of the compressor.

SUMMARY OF THE INVENTION

The present invention has been made in view of the above problem, and its object is to provide a hybrid compressor device capable of reducing its production cost and its size, while ensuring cooling performance after the stop of a vehicle engine.

It is an another object of the present invention to provide a hybrid compressor device which has improved reliability while being produced in low cost.

According to the present invention, a hybrid compressor device includes a pulley rotated by a vehicle engine that is stopped when the vehicle is temporally stopped, a motor rotated by electric power from a battery of the vehicle, a compressor operated by driving force of the pulley and driving force of the motor, a transmission mechanism for changing and transmitting rotation force, and a control unit for adjusting the rotational speed of the motor. Here, the compressor is for compressing refrigerant in a refrigerant cycle system provided in the vehicle. The transmission mechanism is connected to a rotational shaft of the pulley, a rotational shaft of the motor and a rotational shaft of the compressor, so that a rotational speed of the pulley and a rotational speed of the motor are changed and transmitted to the compressor. In the hybrid compressor device, the pulley, the motor and the compressor are disposed to be rotatable independently. Further, the control unit changes the rotational speed of the compressor by adjusting the rotational speed of the motor with respect to the rotational speed of the pulley. Accordingly, the rotational speed of the compressor can be increased and decreased with respect to the rotational speed of the pulley, thereby changing a discharge capacity of the compressor. When the heat load of the refrigerant cycle system becomes maximum as in a cool down mode (quickly cooling mode), the discharge amount of the compressor can be effectively increased by increasing the rotational speed of the compressor than the rotation speed of the pulley by the adjustment of the rotation speed of the motor. Therefore, the size of the compressor and the discharge amount of the compressor can be set smaller. On the contrary, the discharge amount of the compressor can be reduced by reducing the rotational speed of the compressor than the rotation speed of the pulley by the adjustment of the rotation speed of the motor. Therefore, the compressor can quickly corresponds to the heat load of the refrigerant cycle system in a normal cooling mode after the end of the cool down mode. Furthermore, even when the engine is stopped due to idling stop and the rotational speed of the pulley becomes zero, the compressor can be operated by operating the motor. Therefore, even in the idling stop time, cooling operation can be maintained in low cost without using a solenoid clutch.

Preferably, the transmission mechanism is a planetary gear including a sun gear, a planetary carrier and a ring gear, and the rotational shafts of the pulley, the motor and the compressor are connected to the sun gear, the planetary carrier and the ring gear of the planetary gear. Here, the connection between the rotation shafts of the pulley, the motor and the compressor, and the sun gear, the planetary carrier and the ring gear of the planetary gear can be arbitrarily changed. For example, the rotational shaft of the compressor is connected to the planetary carrier, the rotational shaft of the pulley is connected to the sun gear, and the rotational shaft of the motor is connected to the ring gear. Alternatively, the rotational shaft of the pulley is connected to the planetary carrier, the rotational shaft of the motor is connected to the sun gear, and the rotational shaft of the compressor is connected to the ring gear. Alternatively, the rotational shaft of the motor is connected to the sun gear, and the rotational shaft of the compressor is connected to the ring gear, and the rotation shaft of the compressor is connected to the planetary carrier.

Preferably, a lock mechanism is provided for locking the rotational shaft of the motor when the motor is stopped. In this case, when the compressor is operated by driving force of the pulley while the motor is stopped, the control unit detects fluctuation of an induced voltage of the motor by detecting leakage fluctuation of magnetic flux of the motor generated due to rotation of the transmission mechanism connected to the compressor. Accordingly, when a trouble such as lock is caused in the compressor, the rotation of the transmission mechanism is reduced or becomes zero, so that the fluctuation of the induced voltage becomes smaller. Thus, an abnormal operation of the compressor can be readily detected by effectively using the fluctuation of the magnetic flux of the motor.

The hybrid compressor device of the present invention can be applied to a vehicle having an engine that is stopped in a predetermined running condition of the vehicle having a driving motor for driving the vehicle.

On the other hand, in a hybrid compressor where a compressor for compressing refrigerant in a refrigerant cycle system is operated by at least one of a driving unit and a motor, the compressor includes a suction area into which refrigerant before being compressed is introduced, a discharge area into which compressed refrigerant flows, and an oil separating unit for separating lubrication oil contained in refrigerant from the refrigerant and for storing the separated lubrication oil in the discharge area. Further, a transmission mechanism is disposed between the compressor and at least any one of the driving unit and the motor, for changing a rotational speed of the at least one of the driving unit and the motor, to be transmitted to the compressor. In addition, both of the motor and the transmission mechanism are disposed in a housing, an oil introducing passage is provided so that the lubrication oil stored in the discharge area is introduced into the housing through the oil introducing passage, and an inner space of the housing communicates with the suction area of the compressor through a communication passage.

Accordingly, lubrication oil contained in refrigerant is separated from the refrigerant by the oil separating unit, and the separated lubrication oil is introduced into the housing. Further, the introduced lubrication oil is circulated from the housing into the suction area of the compressor. Therefore, lubrication oil can be always supplied to the transmission mechanism in the housing, thereby improving reliability of the transmission mechanism. Further, since the motor is also disposed in the housing, the motor can be cooled by the lubrication oil, thereby improving reliability of the motor. Because lubrication oil is separated from the refrigerant by the oil separating unit, refrigerant, circulated in the refrigerant cycle system, contains almost no lubrication oil. Therefore, lubrication oil is not adhered to a heat exchanger such as an evaporator provided in the refrigerant cycle system, thereby preventing heat-exchange efficiency of the heat exchanger from being reduced.

Preferably, the housing is disposed to accommodate the compressor, the motor and the transmission mechanism. Further, the housing has a suction port, from which the refrigerant is sucked into the compressor, at a side where the motor and the transmission mechanism are disposed. Therefore, the motor and the transmission mechanism can be effectively cooled by the refrigerant introduced into the housing.

More preferably, the oil introduction passage is a first decompression passage through which the discharge area of the compressor communicates with the inside of the housing while pressure is reduced from the discharge area of the compressor toward the inside of the housing, and the communication passage is a second decompression passage through which the inside of the housing communicates with the suction area of the compressor while the pressure is reduced from the inside of the housing toward the suction area of the compressor. Therefore, the lubrication oil can be smoothly circulated between the compressor and the housing.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the appended drawings.

(First Embodiment)

Figure 1:
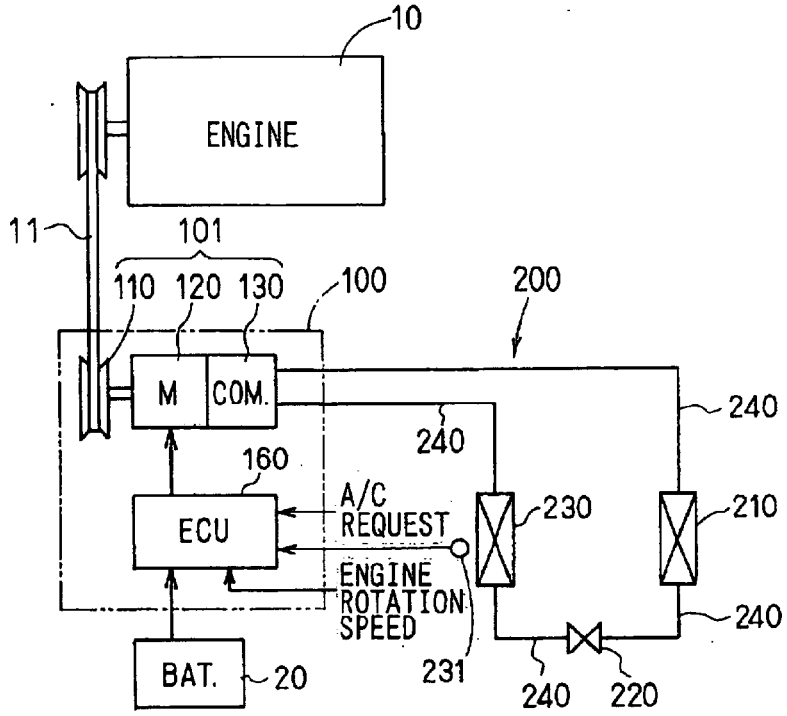
FIG. 1 is an entire schematic diagram showing a refrigerant cycle system to which the present invention is typically applied.

The first embodiment of the present invention will be now described with reference to FIGS. 1–5. In FIG. 1, a hybrid compressor device 100 is typically applied to a refrigerant cycle system 200 mounted in an idling stop vehicle where a vehicle engine 10 is stopped when the vehicle is temporally stopped. The hybrid compressor device 100 includes a hybrid compressor 101 and a control unit 160. The refrigerant cycle system 200 includes components such as a compressor 130, a condenser 210, an expansion valve 220 and an evaporator 230. The components are sequentially connected by refrigerant piping 240, to form a closed circuit. The compressor 130 constructs the hybrid compressor 101. The compressor 130 compresses refrigerant, circulating in the refrigerant cycle system, to a high temperature and high pressure. The compressed refrigerant is condensed in the condenser 210, and the condensed refrigerant is adiabatically expanded by the expansion valve 220. The expanded refrigerant is evaporated in the evaporator 230, and air passing the evaporator 230 is cooled due to the evaporation latent heat of the evaporated refrigerant. An evaporator temperature sensor 231 is disposed at a downstream air side of the evaporator 230, for detecting a temperature of air cooled by the evaporator 230 (post-evaporator air temperature) Te. The post-evaporator air temperature Te is a representative value used for determining a heat load of the refrigerant cycle system 200.

Figure 2:
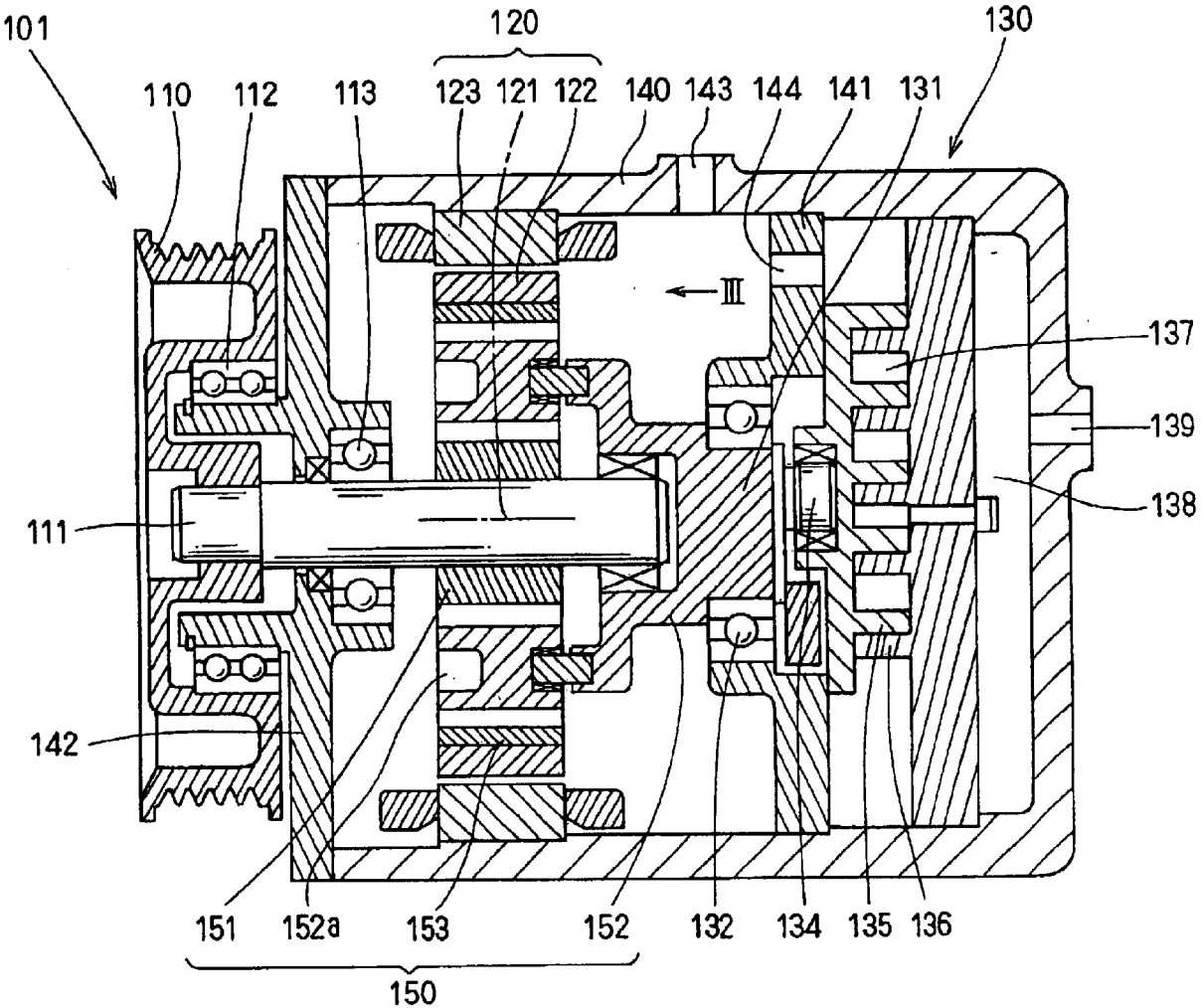
FIG. 2 is a cross-sectional view showing a hybrid compressor device according to a first embodiment of the present invention shown in FIG. 1.

The hybrid compressor 101 is mainly constructed by a pulley 110, a motor 120 disposed in a housing 140 and the compressor 130. As shown in FIG. 2, the pulley 110 includes a pulley rotational shaft 111 at a center of itself, and is rotatablly supported by the housing 140 through bearings 112, 113. Driving force of the engine 10 is transmitted to the pulley 110 through a belt 11, so that the pulley 110 is rotated. The motor 120 includes magnets 122 constructing a rotor, and a stator 123. The magnets 122 are fixed to an outer periphery of a ring gear 153 constructing a planetary gear 150 described later, and the stator 123 is fixed to an inner periphery of the housing 140. The motor 120 has a motor rotational axis 121, shown by a chain line in FIG. 2, at a center of the magnets 122, that is, at a center of the ring gear 153. Electric power is supplied to the stator 123 from a battery 20 as a power source, so that the magnets 122 are rotated.

The compressor 130 is a fixed displacement compressor where a discharge capacity is fixed at a predetermined value. More specifically, the compressor 130 is a scroll type compressor. The compressor 130 includes a fixed scroll 136 fixed to the housing 140 and a movable scroll 135 revolved about a compressor rotational shaft 131 by an eccentric shaft 134 provided at a top end of the compressor rotational shaft 131. The compressor rotational shaft 131 is rotatablly supported by a partition plate 141 through a bearing 132 provided on the partition plate 141. Refrigerant is sucked into the housing 140 from a suction port 143 provided on the housing 140, and flows into a compressor chamber 138 through a through hole 144 provided in the partition plate 141. Then, the refrigerant is compressed in the compression chamber 137, and is discharged from a discharge port 139 through a discharge chamber 138. Here, the sucked refrigerant contacts the motor 120, so that the motor 120 is cooled by the sucked refrigerant, thereby improving durability of the motor 120.

Figure 3:
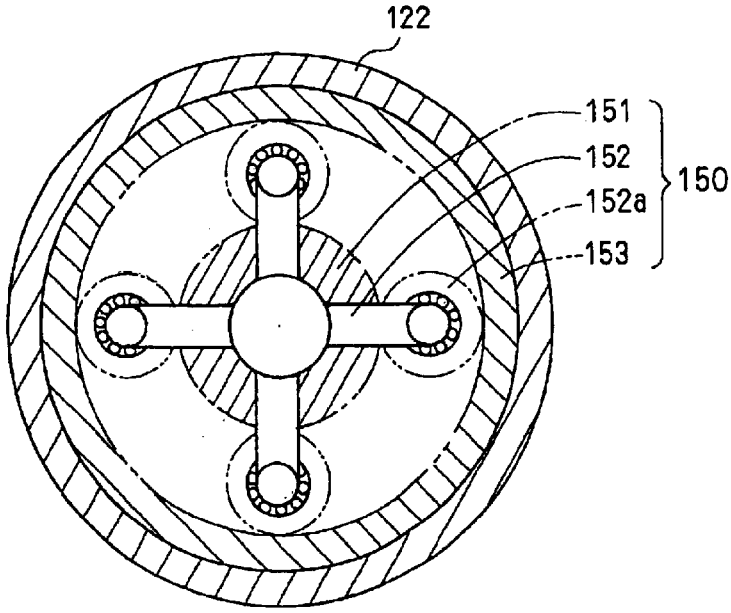
FIG. 3 is a front view showing a planetary gear taken from the arrow III in FIG. 2.

In the present invention, as described later, the compressor 130 is driven by operating both of the pulley 110 and the motor 120 in accordance with the heat load of the refrigerant cycle system 200. Therefore, the discharge capacity of the compressor 130 and its size can be smaller than those of a compressor driven by operation of any one of the pulley 110 and the motor 120. For example, the discharge capacity and the size of the compressor 130 can be set at ½–⅓ of those of the compressor driven by the operation of one of the pulley 110 and the motor 120. The pulley rotational shaft 111, the motor 120, and the compressor rotational shaft 131 are connected to the planetary gear 150 as a transmission mechanism disposed in the housing 140. The rotational speed of the pulley 110 and the rotational speed of the motor 120 are changed and transmitted to the compressor 130 by the planetary gear 150. As shown in FIG. 3, the planetary gear 150 includes a sun gear 151 at a center of itself, planetary carriers 152 connected to pinion gears 152*a*, and a ring gear 153 provided outside the pinion gears 152*a* at an opposite side of the sun gear 150. Each pinion gear 152*a* rotates, and revolves about the sun gear 151. When the planetary gear 150 is rotated, the following relationship is satisfied among the driving force of the sun gear 151 (sun gear torque), the driving force of the planetary carriers 152 (planetary carrier torque) and the driving force of the ring gear 153 (ring gear torque).

planetary carrier torque=sun gear torque+ring gear torque

Here, the pulley rotational shaft 111 is connected to the sun gear 151, and the motor 120 is connected to the ring gear 153. The compressor rotational shaft 131 is connected to the planetary carries 152.

The control unit 160 inputs an air-conditioning (A/C) requirement signal, a temperature signal from the evaporator temperature sensor 231, an engine rotational speed signal and the like, and controls the operation of the motor 120 based on the input signals. Specifically, the control unit 160 changes a rotational speed of the motor 120 by changing electric power from the battery 20. The control unit 160 determines a refrigerant discharge amount of the compressor 130 in accordance with the heat load of the refrigerant cycle system 200, based on a control characteristic shown in FIG. 4A. Similarly, the control unit 160 determined a rotational speed of the compressor 130 to ensure the refrigerant discharge amount, based on a control characteristic shown in FIG. 4B. The discharge amount is defined by multiplying the discharge capacity per rotation of the compressor 130 and a the rotational speed of the compressor 130 together. As the rotational speed of the compressor 130 is increased, the discharge amount of the compressor 130 is increased. The control unit 160 determines the rotational speed of the motor 120 by using the rotational speed of the pulley 110 and the rotational speed of the compressor 130, based on the graph of the planetary gear 150 shown in FIG. 5.

Next, operation of the above structure according to the first embodiment will be described. In the hybrid compressor 101, the compressor 130 is operated by the rotational driving force of the pulley 110, and by the rotational driving force of the motor 120 through the planetary gear 150. The rotational speed of the motor 120 is adjusted by the control unit 160, and the rotational speed of the compressor 130 is increased and decreased with respect to the rotational speed of the pulley 110.

Figure 4A:
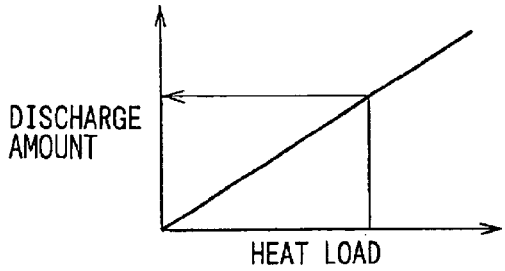
FIG. 4A is a control characteristic graph showing a relationship between a discharge amount of a compressor and a heat load of the refrigerant cycle system according to the first embodiment.
Figure 4B:
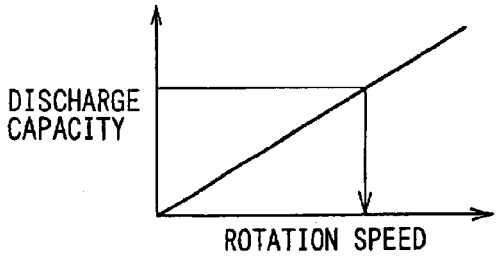
FIG. 4B is a control characteristic graph showing a relationship between the discharge amount of the compressor and a rotational speed of the compressor according to the first embodiment.
Figure 5:
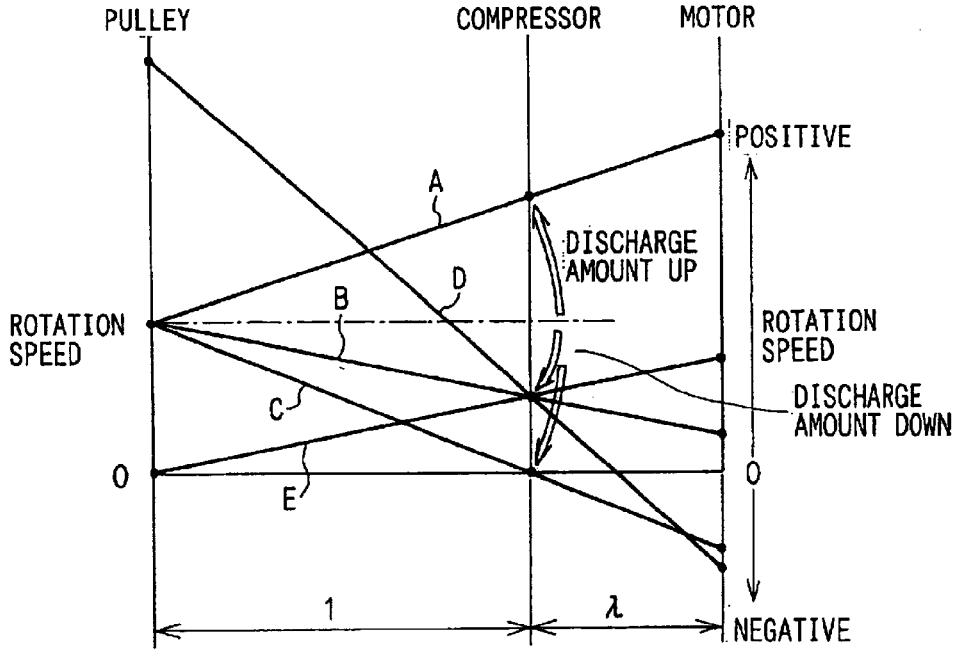
FIG. 5 is a graph showing rotational speeds of a pulley, the compressor and a motor of the hybrid compressor which are shown in FIG. 2.

FIG. 5 shows the rotation speed of the sun gear 151, the planetary carriers 152 and ring gear 153. In the abscissa of FIG. 5, a position of the planetary carriers 152 is determined by a gear ratio of the ring gear 153 to the sun gear 151. Here, the gear ratio is set at 0.5. The rotational speeds of the sun gear 151, the planetary carriers 152 and ring gear 153 are located on a straight line in FIG. 5. The control unit 160 calculates the rotational speed of the pulley 110 from the rotational speed signal of the engine 10. Then, as shown in FIGS. 4A, 4B, the control unit 160 determines the rotational speed of the compressor 130 to ensure the discharge amount thereof required for the heat load of the refrigerant cycle system 200. In the graph of FIG. 5, a straight line is drawn from the calculated rotational speed of the pulley 110 to the determined rotational speed of the compressor 130. Since the rotational speed of the motor 120 is located on the extension line of the straight line, the rotational speed of the motor 120 is determined based on the graph of FIG. 5. Thus, the motor 120 is operated at the determined rotational speed.

Further, operational control of the motor 120 will be specifically described with reference to FIG. 5. In a cool down mode (quickly cooling mode) where the heat load of the refrigerant cycle system 200 becomes maximum, as shown by the straight line A in FIG. 5, the rotational speed of the motor 120 is increased, so that the rotational speed of the compressor 130 is made higher than the rotational speed of the pulley 110. Thus, the discharge amount of the compressor 130 is increased, and the compressor 130 can be operated to correspond to the high heat load of the refrigerant cycle system 200.

In a normal cooling mode after the end of the cool down mode, the increased discharge amount of the compressor 130 is not required. Therefore, as shown by the straight line B in FIG. 5, the rotational speed of the motor 120 is reduced, and the rotational speed of the compressor 130 is made lower than the rotational speed of the pulley 110. Thus, the discharge amount of the compressor 130 is reduced to a discharge amount required in the normal cooling mode.

When the heat load of the refrigerant cycle system 200 is further reduced and the discharge amount of the compressor 130 becomes surplus, the motor 120 is operated in an inverse rotational direction as shown by the straight line C in FIG. 5, and the rotational speed of the compressor is set at zero. Thus, the discharge amount of the compressor 130 is set at zero. That is, the discharge amount of the compressor 130 can be set zero by adjusting the rotational speed of the motor 120 without using a solenoid clutch as in the conventional art. In this case, the motor 120 receives rotational force from the planetary carriers 152 connected to the compressor 130, and is rotated in the inverse rotational direction to generate electric power.

In the normal cooling mode, when the vehicle runs at a high speed, the motor 120 is operated in the inverse rotational direction as shown by the straight line D, and the compressor 130 is operated at the same rotational speed as in the straight line B. Thus, the normal cooling mode is maintained while ensuring the same discharge amount of the compressor 130 as in the normal cooling mode when the vehicle runs in a normal speed. In the cases of the straight lines C, D of FIG. 5, the motor 120 is operated in the inverse rotational direction, and power generation can be performed, so that the battery 20 is charged. Further, when the idling stop vehicle is temporarily stopped and the engine 10 is stopped, that is, when the rotational speed of the pulley 110 becomes zero as shown by the straight line E in FIG. 5, the motor 120 is operated at an intermediate rotational speed level, and the rotational speed of the compressor 130 is maintained at the same rotational speed as in the straight line B in FIG. 5. Accordingly, even when the engine 10 stops, the required discharge amount of the compressor 130 is ensured, and operation of the refrigerant cycle system 200 is continued.

Next, operational effects of the hybrid compressor device having the above structure will be described. The rotational speed of the compressor 130 can be increased and decreased with respect to the rotational speed of the pulley 110 by the adjustment of the rotational speed of the motor 120. Thus, the discharge amount of the compressor 130 is changed based on the rotation speed of the pulley 110 and the rotation speed of the motor 120. Further, the rotational speed of the compressor 130 can be increased than the rotational speed of the pulley 110, so that the discharge amount of the compressor 130 can be increased than the discharge amount of the compressor according to the prior art. Therefore, the size of the compressor 130 and the discharge amount thereof can be set smaller than those in the prior art. On the contrary, the rotational speed of the compressor 130 can be reduced than the rotational speed of the pulley 110, so that the discharge amount of the compressor 130 can be reduced. Therefore, the compressor 130 can be operated to quickly correspond to the heat load of the refrigerant cycle system 200 in the normal cooling mode after the end of the cool down mode. Furthermore, even when the engine 10 is stopped due to the idle stop and the rotational speed of the pulley 110 becomes zero, the compressor 130 can be operated by operating the motor 120. Therefore, in the idling stop time, the cooling mode can be maintained in low cost without using a solenoid clutch.

Since the rotational shaft 131 of the compressor 130 is connected to the planetary carriers 152, both of the driving force of the pulley 110 and the driving force of the motor 120 can be applied to the compressor rotational shaft 131 through the planetary gear 150 including the sun gear 151, the planetary carriers 152 and the ring gear 153. Therefore, both of energy of the pulley 110 and energy of the motor 120 can be supplied to the compressor 130, thereby reducing the load of the engine 10. Further, the pulley rotational shaft 111 is connected to the sun gear 151, and the motor 120 is connected onto the ring gear 153. Therefore, the pulley rotational shaft 111, the compressor rotational shaft 131 and the motor 120 can be connected to the sun gear 151, the planetary carriers 152 and the ring gear 153, respectively, with a simple structure. As a result, production cost of the hybrid compressor 101 can be reduced. Since the discharge amount of the compressor 130 can be changed by adjusting the rotational speed of the motor 120, the hybrid compressor 101 can be constructed by using the fixed displacement compressor 130, thereby further reducing production cost of the hybrid compressor 101.

In the above-described first embodiment, the rotation axis 121 of the motor 120 is described. However, actually, the motor 120 is rotated by a motor shaft (121).

(Second Embodiment)

The second embodiment of the present invention will be now described with reference to FIGS. 6 and 7.

Figure 6:
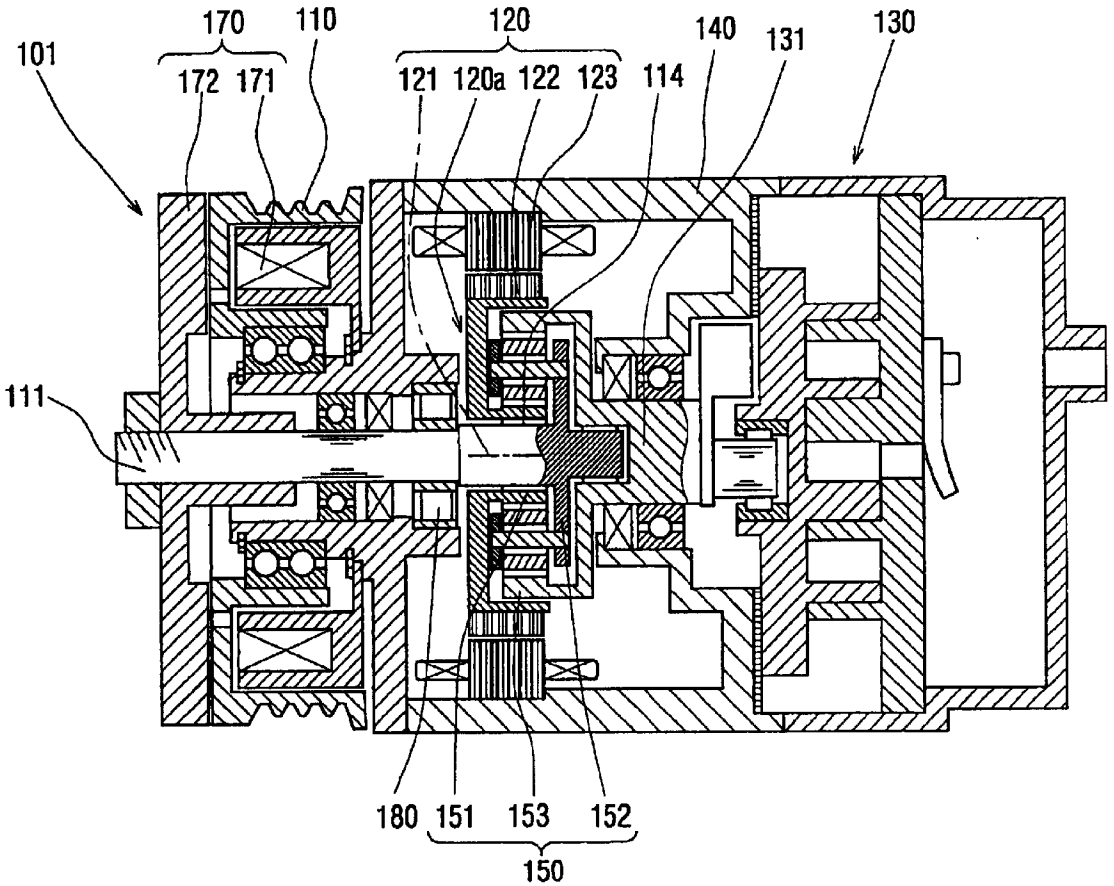
FIG. 6 is a cross-sectional view showing a hybrid compressor device according to a second embodiment of the present invention.
Figure 7:
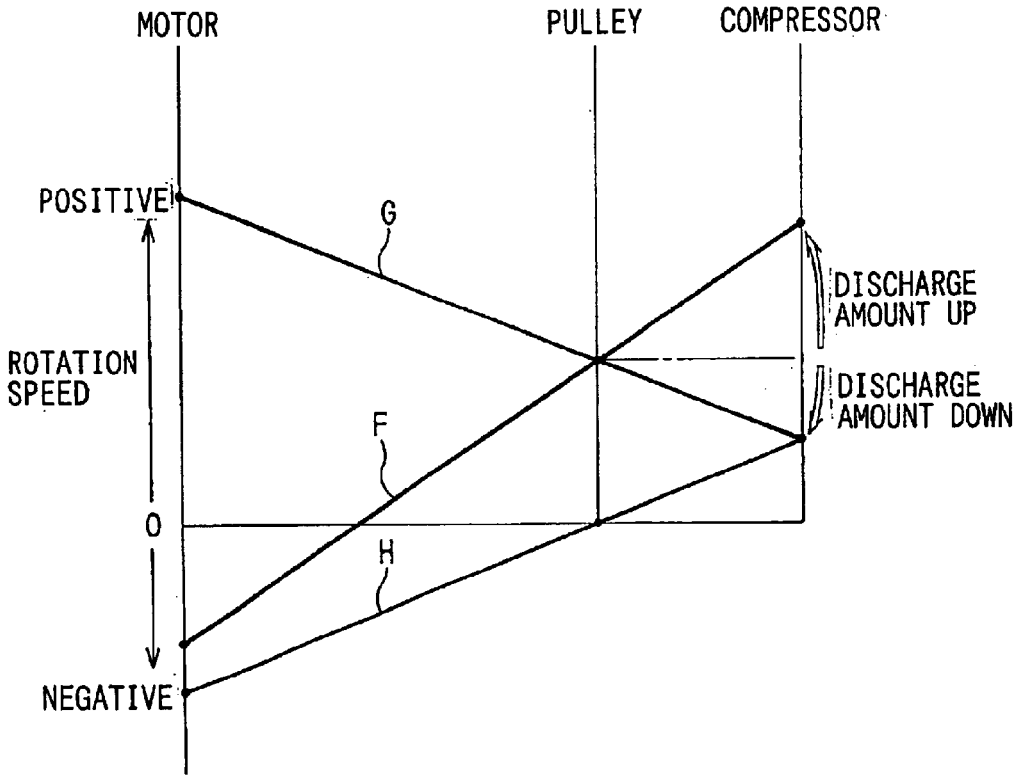
FIG. 7 is a graph showing rotational speeds of a pulley, a compressor and a motor of the hybrid compressor device, according to the second embodiment.

In the second embodiment, as shown in FIG. 6, the planetary gear 150 is disposed in a rotor portion 120*a* of the motor 120, and the pulley rotational shaft 111, the rotation shaft of the motor 120 and the compressor rotational shaft 131 are connected to the planetary gear 150, as compared with the first embodiment. Further, a solenoid clutch 170 and a one-way clutch 180 are added to the hybrid compressor 101 as compared with the first embodiment. Here, a surface permanent-magnet motor (SP motor), where permanent magnets are provided on an outer periphery of the rotor portion 120*a*, is used as the motor 120. The planetary gear 150 is disposed in a space of the rotor portion 120*a* on the inner periphery side. The pulley rotational shaft 111 is connected to the planetary carriers 152, and the rotor portion 120*a* of the rotor 120 is connected to the sun gear 151. The compressor rotational shaft 131 is connected onto the ring gear 153. The rotor portion 120*a* and the ring gear 153 can be rotated in independent from the pulley rotational shaft 111 by a bearing 114.

The solenoid clutch 170 and the one-way clutch 180 are provided on the pulley rotational shaft 111. The solenoid clutch 170 is for interrupting the driving force from the engine 10 to the pulley rotational shaft 111, and is constructed by a coil 171 and a hub 172. The hub 172 is fixed to the pulley rotational shaft 111. When the coil 171 is energized, the hub 172 contacts the pulley 110, and the solenoid clutch 170 is turned on, so that the pulley rotational shaft 111 is rotated together with the pulley 110. When the coil 171 is de-energized, the hub 172 and the pulley rotational shaft 111 are separated from the pulley 110, and the solenoid clutch 170 is turned off. The on-off operation of the solenoid clutch 170 is performed by the control unit 160. The one-way clutch 180 is disposed near the planetary gear 150 between the planetary gear 150 and the solenoid clutch 170 in the axial direction of the pulley rotation shaft 111, and is fixed to the housing 140. The one-way clutch 180 allows the pulley rotational shaft 111 to rotate only in a regular rotational direction, and prevents the pulley rotational shaft 111 from rotating in an inverse rotational direction.

Next, operation of the hybrid compressor having the above structure according to the second embodiment will be described with reference to FIG. 7. In the cool down mode where the maximum compression capacity is required, the solenoid clutch 170 is turned on, and the driving force of the pulley 110 is transmitted from the pulley rotational shaft 111 to the compressor rotational shaft 131 through the planetary gear 150. In this case, the compressor 130 is operated, and the one-way clutch 180 is in idling. At this time, as shown by the straight line F in FIG. 7, the motor 120 is rotated in an inverse direction from the rotational direction of the pulley 110, thereby increasing the rotational speed of the compressor 130 than the rotational speed of the pulley 110, and increasing the discharge amount of the compressor 130. As the rotational speed of the motor 120 is increased, the rotational speed of the compressor 130 is increased.

In the normal cooling mode after the cool down mode, the solenoid clutch 170 is turned on, and the motor 120 and the compressor 130 are operated mainly by the driving force of the pulley 110 while the one-way clutch 180 is in idling. At this time, since the compressor 130 performs compression work, operation torque of the compressor 130 is larger than operation torque of the motor 120. Therefore, as shown by the straight line G in FIG. 7, the compressor 130 is operated at a lower rotational speed than the pulley 110, and the discharge amount of the compressor 130 is reduced. On the other hand, the motor 120 is operated as a generator at a higher rotational speed higher than the pulley 110, and the motor 120 charges the battery 20. Here, as the rotational speed of the motor 120 is reduced, the rotational speed of the compressor 130 is increased.

When the engine 10 is stopped, the solenoid clutch 170 is turned off, the compressor 130 is operated by the driving force of the motor 120. At this time, as shown by the straight line H in FIG. 7, the motor 120 is operated in the inverse rotational direction, and driving force of the motor 120 is applied to the pulley rotational shaft 111 in the inverse rotational direction. In this case, the pulley 110 is locked by the one-way clutch 180, and the driving force of the motor 120 is transmitted to the compressor 130. Here, as the rotational speed of the motor 120 is increased and reduced, the rotational speed of the compressor 130 is increased and reduced. Even when the engine 10 is operated, if the solenoid clutch 170 is turned off, the compressor 130 can be operated by driving the motor 120 in the inverse rotational direction, as in the stop of the engine 10.

As described above, since the SP motor is used as the motor 120, the planetary gear 150 can be efficiently disposed in the space of the rotor 120*a*, thereby reducing the size of the hybrid compressor 101. Further, the pulley rotational shaft 111, the motor 120 and the compressor rotational shaft 131 are connected to the planetary carriers 152, sun gear 151 and the ring gear 153, respectively. Therefore, a speed reduction ratio of the compressor 130 relative to the motor 120 can be made larger, and the motor 120 can have a high rotational speed and a low torque, thereby reducing the size of the hybrid compressor 101 and the production cost thereof.

Further, in the second embodiment, the solenoid clutch 170 and the one-way clutch 180 are provided. Therefore, even when the engine 10 is operated, when the heat load of the refrigerant cycle system 200 is low and sufficient electric power is stored in the battery 120, the compressor 130 can be operated by the motor 120 using electric power from the battery 20. Thus, an operational ratio of the engine 10 can be reduced, thereby improving fuel consumption performance. In the second embodiment, the other parts are similar to those of the above-described first embodiment.

(Third Embodiment)

Figure 8:
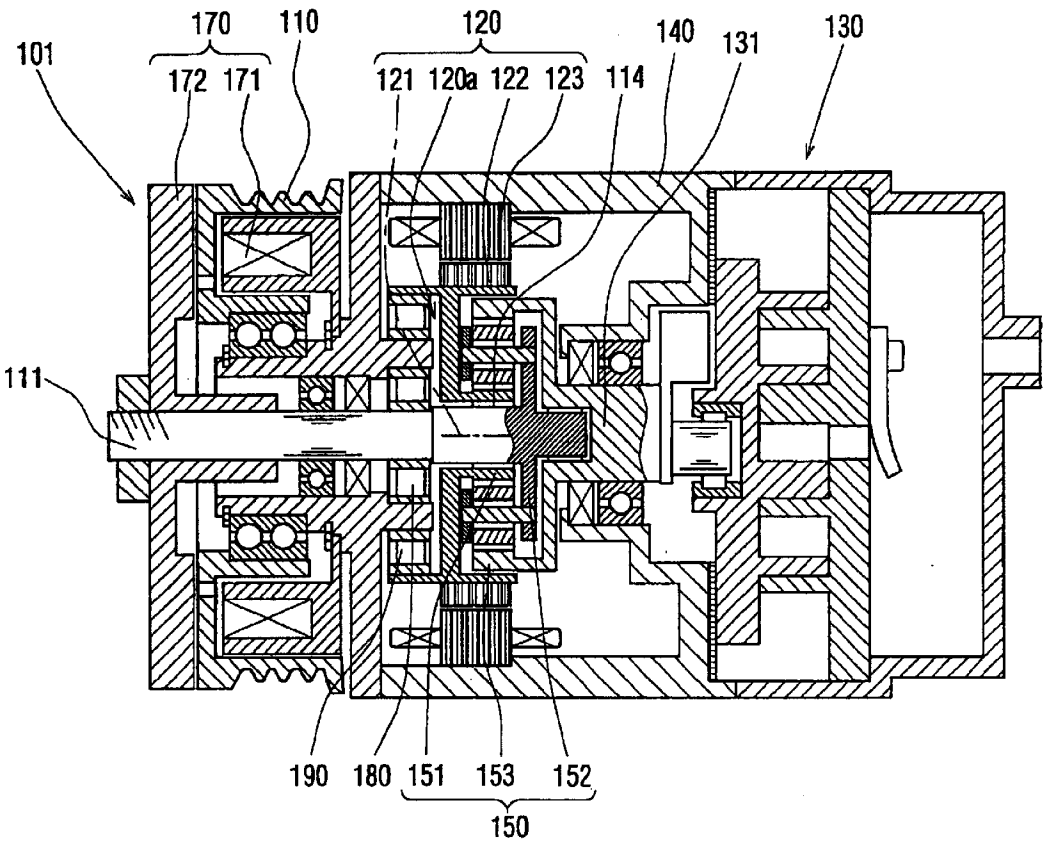
FIG. 8 is a cross-sectional view showing a hybrid compressor device according to a third embodiment of the present invention.
Figure 9:
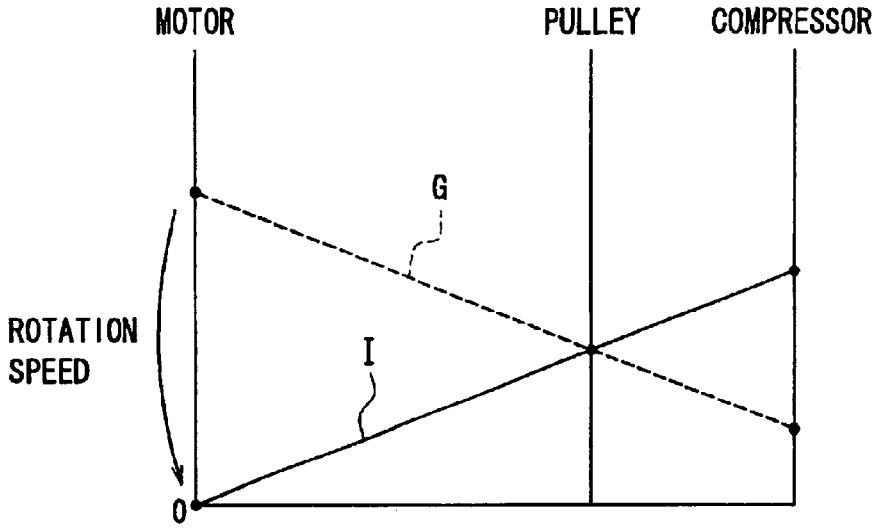
FIG. 9 is a graph showing rotational speeds of a pulley, a compressor and a motor of the hybrid compressor device, according to the third embodiment.

The third embodiment of the present invention will be now described with reference to FIGS. 8 and 9. As shown in FIG. 8, in the third embodiment, an another one-way clutch (second one-way clutch) 190 is added to the hybrid compressor 101, as compared with the second embodiment. The second one-way clutch 190 allows the motor 120 to rotate only in the inverse rotational direction from the rotational direction of the pulley 110. The second one-way clutch 190 is disposed between the rotor portion 120*a* of the motor 120 and the housing 140.

In the third embodiment, the operation of the hybrid compressor 101 is different from the second embodiment in the normal cooling mode after the cool down mode, among the cool down mode, the normal cooling mode after the cool down mode, the cooling mode in the stop of the engine 10 and the cooling mode in the operation of the engine 10. As shown by the straight line G in FIG.9 (corresponding to the straight line G in FIG.7), in the above-described second embodiment, the motor 120 and the compressor 130 are operated by the driving force of the pulley 110. However, in the third embodiment, as shown by the straight line I in FIG. 9, the motor 120 is locked and stopped by the second one-way clutch 190 in the rotational direction of the pulley 110. Therefore, all of the driving force of the pulley 110 can be transmitted to the compressor 130, and the rotational speed of the compressor 130 is increased with respect to the rotational speed of the pulley 110.

Accordingly, driving force for driving the motor 120 to generate electric power is not required, the load of the engine 10 is reduced, thereby improving fuel consumption performance. Further, since the motor 120 does not perform power generation, control for the power generation is not required. Furthermore, electric power is not required from the motor 120 to the compressor 130, and power consumption of the battery can be reduced. Even if the positions of the motor shaft 121 and the compressor rotational shaft 131 connected to the planetary gear 150 are interchanged from each other, the same operational effects as in the second embodiment can be obtained. In the third embodiment, the other parts are similar to those of the above-described second embodiment.

(Fourth Embodiment)

Figure 10:
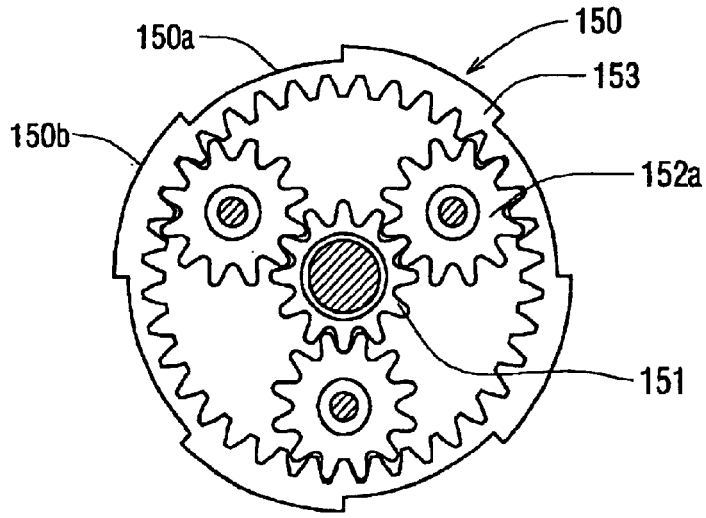
FIG. 10 is a front view showing a planetary gear including recess portions and protrusion portions according to a fourth embodiment of the present invention.
Figure 11:
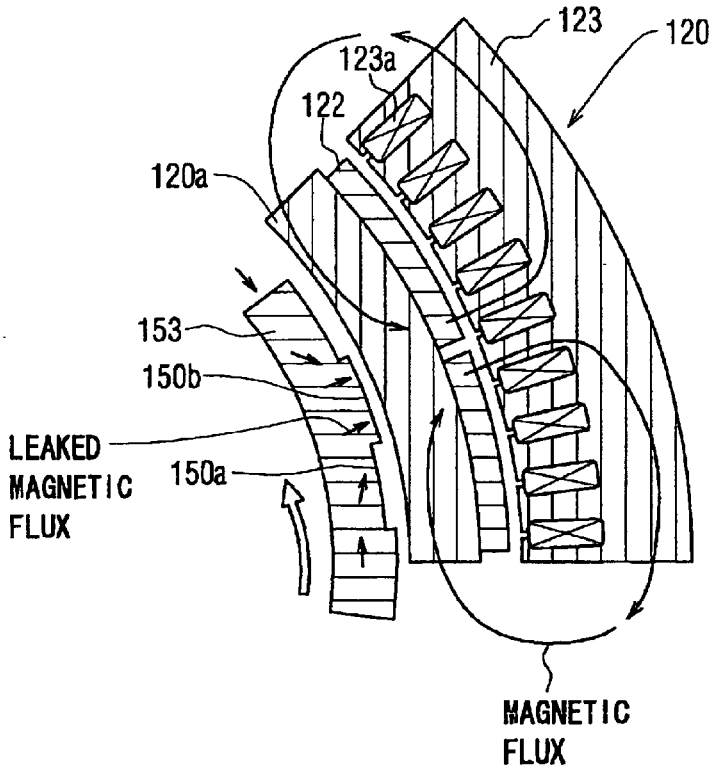
FIG. 11 is an enlarged schematic diagram showing magnetic flux and leaked magnetic flux in the motor, according to the fourth embodiment.

The fourth embodiment of the present invention will be now described with reference to FIGS. 10–14. In the fourth embodiment, an abnormal-operation detection function of the compressor 130 and a protection function for protecting the engine 10 are further added to the hybrid compressor device 100, as compared with the third embodiment. As shown in FIG. 10, in the fourth embodiment, recess portions 150*a* and protrusion portions 150*b* are provided on an outer periphery of the ring gear 153 to which the compressor rotational shaft 131 is connected. As shown in FIG. 11, magnetic flux is generated between the rotor portion 120*a* and the stator portion 123 to be turned. A very small amount of magnetic flux leaks to a radial inner side of the rotor portion 120*a*, and to a radial outer side of the stator 123. When the ring gear 153 having the recess portions 150*a* and the protrusion portions 150*b* is rotated while the magnetic flux leaks, magnetic resistance is changed at the radial inner side of the rotor portion 120*a* every passing of the recess portions 150*a* and the protrusion portions 150*b*. Then, the magnetic flux is changed in the stator 123. Thus, an induced voltage V defined by the following formula (1) is generated between both ends of one coil 123*a* of the stator 123.

$$V=N\times d\Phi/dt \quad (1)$$

Figure 12:
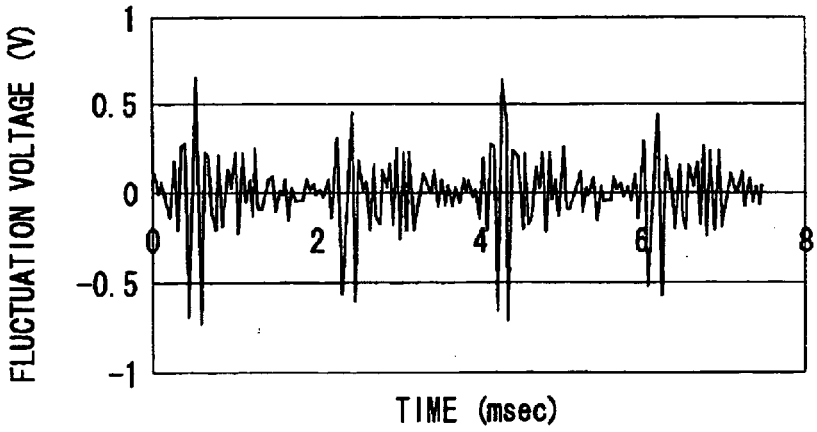
FIG. 12 is a graph showing fluctuation of an induced voltage of the motor relative to a time according to the fourth embodiment.

Here, N is the number of turns of the coil 123*a*, Φ is magnetic flux, and "t" is a time. The fluctuation of the induced voltage between both the ends of the coil 123*a* is calculated by a finite element method (FEM) analysis, and the calculated result is shown in FIG. 12. As seen from FIG. 12, the fluctuation of the induced voltage can be determined by the control unit 160 even at a lower operational state of the compressor 130, such as the rotational speed of 2000 rpm, that is, the lower limit level in operation of the compressor 130.

Figure 13:
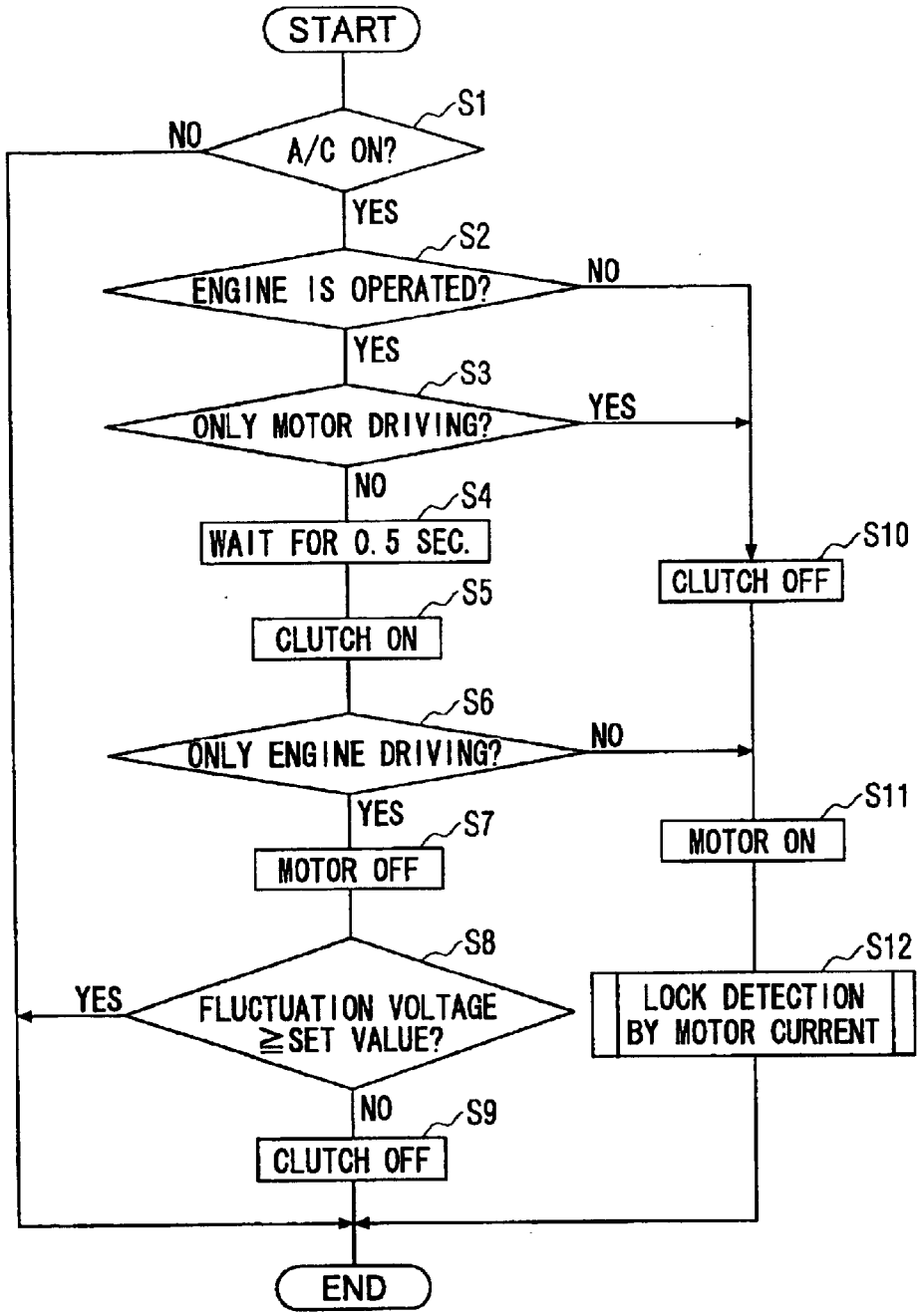
FIG. 13 is flow diagram showing a control process for detecting the fluctuation of the induced voltage of the motor and for protecting a vehicle engine, according to the fourth embodiment.

Next, control operation for detecting the induced voltage V and for protecting the engine 10 will be described with reference to the flow diagram shown in FIG. 13. At step S1, it is determined whether or not an air conditioner (A/C) is turned on. That is, at step S1, it is determined whether or not an air-conditioning request signal is received. When the air conditioner is turned on, that is, when the determination at step S1 is YES, it is determined at step S2 whether or not the engine 10 is operated. When the determination at step S1 is NO, the control program is ended, and is repeated from a start step. When it is determined at step S2 that the engine 10 is operated, it is determined at step S3 whether or not the compressor 130 is required to be operated only by the motor 120. Here, this determination standard is set based on the heat load of the refrigerant cycle system 200. The heat load can be divided into a high heat load in the cool down mode, a middle heat load in the normal cooling mode and a low load, in this order. The compressor 130 is operated generally by the engine 10 and the motor 120 in the cool down mode, and is operated generally only by the engine 10 in the normal cooling mode. Further, the compressor 130 is operated generally only by the motor 120 in the low load mode.

When it is determined at step S3 that the compressor 130 is not required to be driven only by the motor 120, that is, when the determination at step S3 is NO, a standby of the compressor 130 is maintained at step S4. Here, it is predetermined that the rotational speed of the compressor 130 is increased and stabilized for 0.5 second, and the standby is maintained for 0.5 second at step S4. Then, at step S5, the solenoid clutch 170 is turned on. At step S6, it is determined whether or not the compressor 130 is required to be operated only by the engine 10. When the heat load of the refrigerant cycle system 200 is the heat load in the normal cooling mode, that is, when the it is determined at step S6 that the compressor 130 is required to be operated only by the engine 10, operation of the motor 120 is stopped at step S7. Specifically, as described in the third embodiment, when the motor 120 is locked by the second one-way clutch 190, energization for the motor 120 is stopped. Then, the compressor 130 is operated only by the driving force of the engine 10.

At step S8, it is determined whether or not the fluctuation of the induced voltage V generated between both the ends of the coil 123*a* is larger than a predetermined value. When it is determined that the fluctuation of induced voltage is smaller than the predetermined value, it is determined that the compressor 130 connected to the ring gear 153 is not operated at an original rotational speed. At step S9, the solenoid clutch 170 is turned off. When it is determined at step S8 that the fluctuation is larger than or equal to the predetermined value, it is determined that the compressor 130 is normally operated, and the compressor 130 is operated by the engine 10 as it is.

On the other hand, when it is determined at step S2 that the operation of the engine 10 is stopped or it is determined at step S3 that the compressor 130 is required to be operated only by the motor 120, the solenoid clutch 170 is turned off at step S10. Then, at step S11, the motor 120 is turned on, and the compressor 130 is operated by the motor 120. At step S12, operational abnormality (lock) of the compressor 130 is detected by a current value of the motor 120. When it is determined at step S6 that the compressor 130 is not required to be operated only by the engine 10, the motor 120 is turned on at step S11, and the compressor 130 is operated by the engine 10 and the motor 120. A step S12, the abnormality detection is performed by the current value supplied to the motor 120.

When the compressor 130 is operated by the motor 120, if the operational abnormality of the compressor 130 such as the lock thereof occurs, the operational abnormality can be detected by the current value of the motor 120 at step S12. In the fourth embodiment, when the operational abnormality of the compressor 130 such as the lock thereof occurs, the rotational speed of the ring gear 153 connected to the compressor 130 is reduced or becomes zero, and the induced voltage fluctuation of the coil 123*a* is reduced. Therefore, an another detection device is not required, and the operational abnormality of the compressor 130 can be detected by the induced voltage fluctuation. The compressor rotational shaft 131 is connected to the ring gear 153 having the recess portions 153*a* and the protrusion portions 153*b* on the outer periphery of itself. Since the recess portions 153 and the protrusion portions 153*b* are disposed near the radial inner side of the magnets 122, the induced voltage fluctuation can be readily detected. Further, when the detected fluctuation of the induced voltage is smaller than a standard value, that is, when the operational abnormality of the compressor 130 such as the lock thereof occurs, the solenoid clutch 170 is turned of f. Therefore, it can be prevent an overload from being applied to the engine 10, thereby protecting the engine 10.

Figure 14:
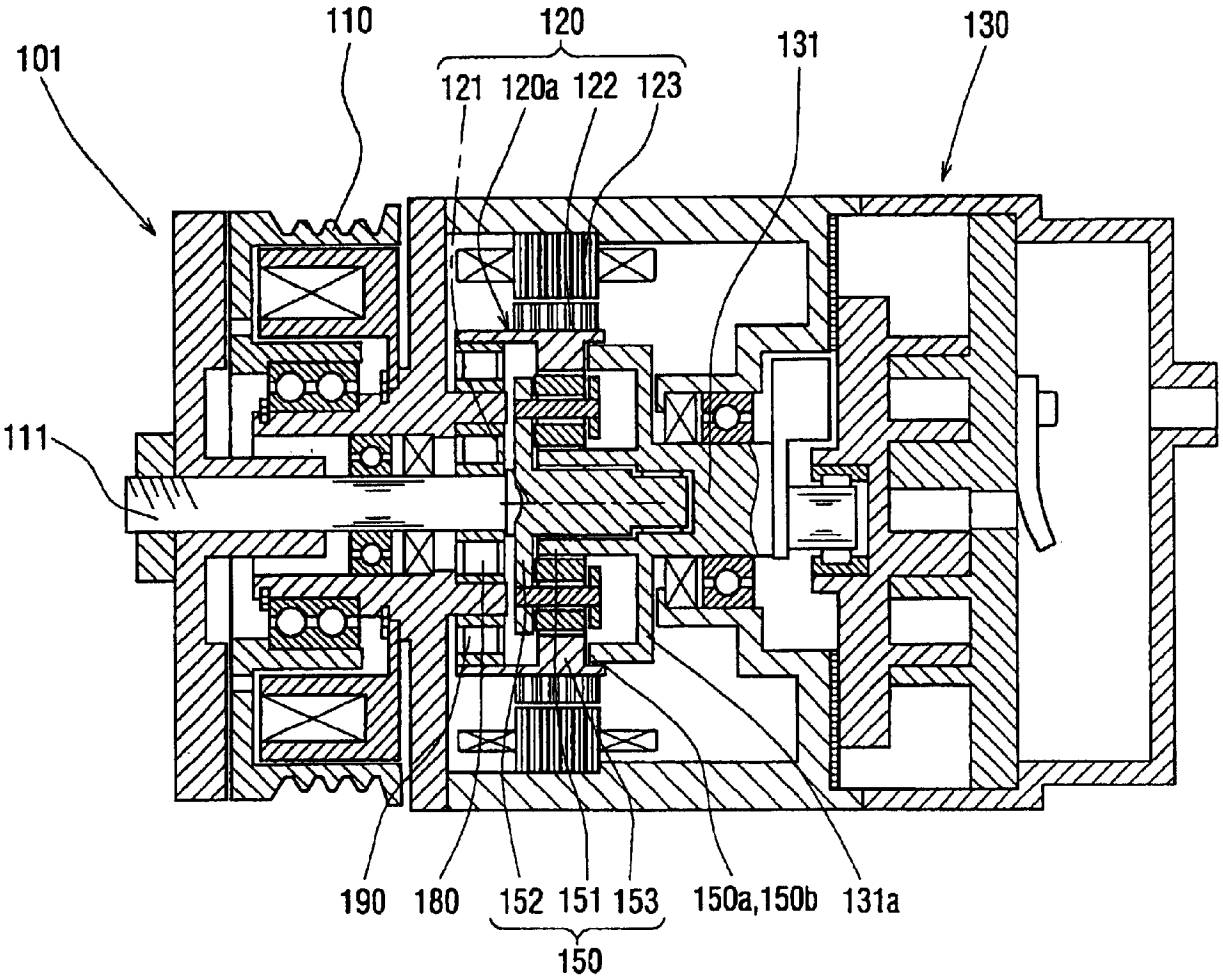
FIG. 14 is a cross-sectional view showing a hybrid compressor device according to a modification of the fourth embodiment.

As shown in FIG. 14, the motor 120 may be connected onto the ring gear 153, and the compressor rotational shaft 131 may be connected to the sun gear 151. In this case, the compressor rotational shaft 131 includes a second rotor portion 131*a*, and an outer periphery side of the second rotor portion 131*a* is located at an inner periphery side of the rotor portion 120*a*. Further, the second rotor portion 131*a* includes the recess portions 150*a* and the protrusion portions 150*b*. Even in this case, the same operational effect can be obtained.

(Fifth Embodiment)

The fifth embodiment of the present invention will be now described with reference to FIG. 15. In the fifth embodiment, the parts similar to those of the above-described embodiments are indicated by the same reference numbers, and detail description thereof is omitted.

Figure 15:
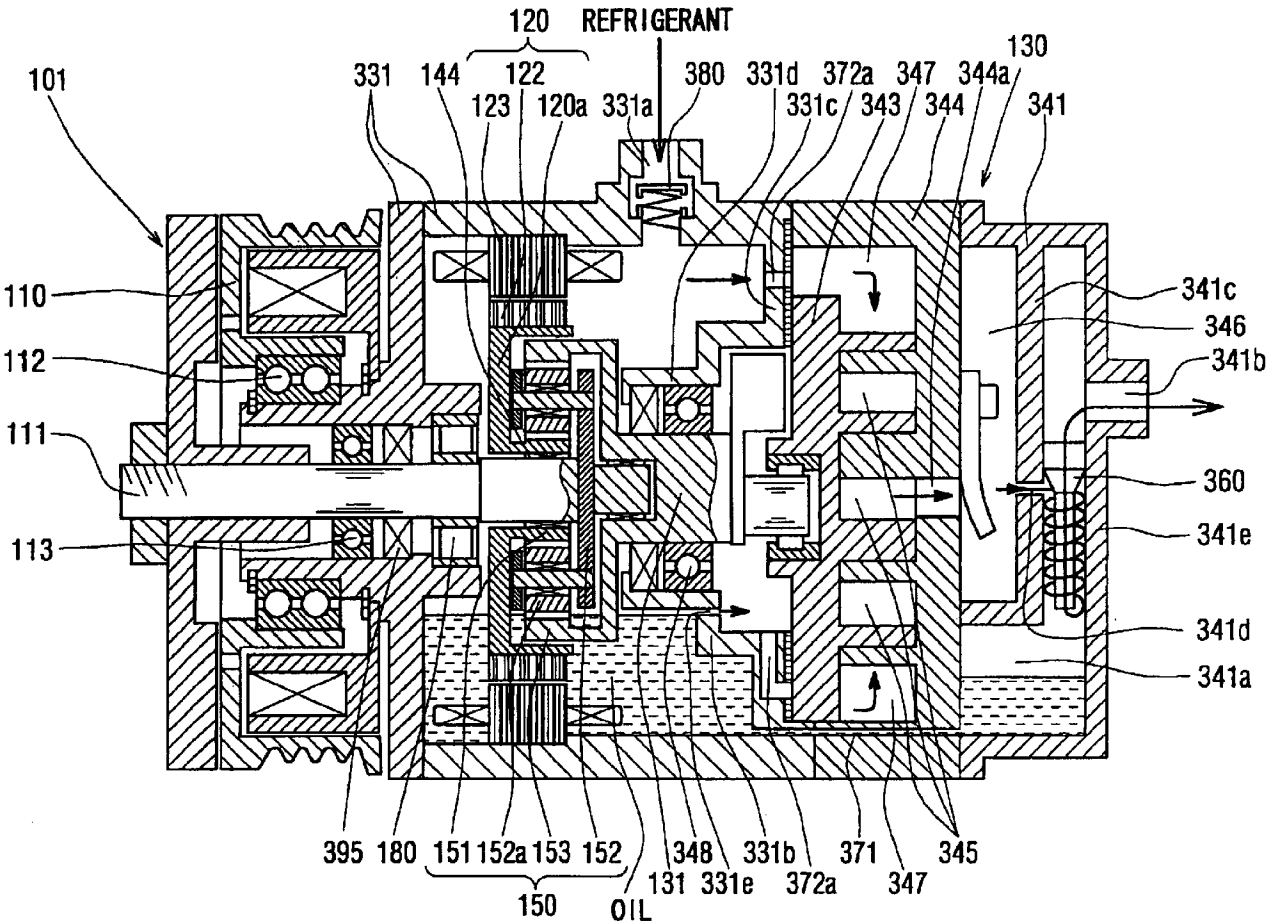
FIG. 15 is a cross-sectional view showing a hybrid compressor device according to a fifth embodiment of the present invention.

In the fifth embodiment, as shown in FIG. 15, the motor 120 and the planetary gear 150 are disposed in a motor housing 331. Further, a suction port 331*a* is formed in an outer periphery portion of a motor housing 331, and a check valve 380 is disposed in the suction port 331*a*. Refrigerant flows out from the evaporator 230 in the refrigerant cycle system 200, and flows into the motor housing 331 from the suction port 331*a*. The check valve 380 prevents refrigerant from flowing out from the motor housing 331 through the suction port 331*a*. Further, a shaft seal device 395 is disposed between the pulley rotational shaft 111 and the motor housing 331, and the shaft seal device 395 prevents refrigerant and lubrication oil from flowing out from the motor housing 331.

The compressor 130 is a fixed displacement compressor where a discharge capacity is set at a predetermined value. For example, the compressor 130 is a scroll type compressor. The compressor 130 includes a fixed scroll 344 forming a part of a compressor housing, and a movable scroll 343 rotated about the compressor rotational shaft 131 by the eccentric shaft 134 provided at the top end of the compressor rotational shaft 131. The fixed scroll 344 and the movable scroll 343 engage with each other, to form a suction chamber 347 at an outer peripheral side, and a compression chamber 345 at an inner side. The fixed scroll 344 is fixed to the motor housing 331 at an opposite side of the pulley 110. The compressor rotational shaft 131 is rotatablly supported by a protrusion wall 331*d* through a bearing 348 provided on the protrusion wall 331*d*. The protrusion wall 331*d* protrudes in parallel to the compressor rotational shaft 131 from a side wall 331*c* of the motor housing 331 at an opposite side of the pulley 110. An end of the compressor rotational shaft 131 at an opposite side of the movable scroll 135 is connected to the ring gear 153.

Suction ports 372*a* are formed in the side wall 331*c* to face each other at two positions on the circumference, and are opened and closed by the movable scroll 343. When one of the suction ports 372*a* is opened, the suction chamber 347 and an inner space of the motor housing 331 communicate with each other. By the suction ports 372*a*, the pressure in the motor housing 331 is made equal to the pressure in the suction chamber 347, that is, sucked refrigerant pressure. In the present invention, the suction chamber 347 corresponds to a suction area of the compressor 130 in the present invention. An opening hole 331*e* is defined by the protrusion wall 331*d* at a lower side of the protrusion wall 331*d*, to be positioned at an upper side than the lowest end of the engagement portion between the pinion gear 152*a* and the ring gear 153 of the planetary gear 150. Further, a storage wall 331*b* is provided for storing a predetermined amount of lubrication oil introduced into the motor housing 331. Because the opening hole 331*e* is provided, lubrication oil can be stored in the storage wall 331*b* by the predetermined amount. The suction port 372*a* at the lower side is located lower than a top end of the storage wall 331*b*.

A compressor cover 341 is fixed to the fixed scroll 344 at a side opposite to the motor housing 331, and a space defined by the compressor cover 341 and the fixed scroll 344 is partitioned by a partition wall 341*c* into a discharge chamber 346 and an oil storage chamber 341*a*. The compression chamber 345 and a discharge chamber 346 communicate with each other through a discharge port 344*a* provided in the fixed scroll 344 at its center. A small-diameter discharge hole 341*d* is provided in the partition wall 341*c*. The discharge chamber 346 and the oil storage chamber 341*a* communicate with each other through the discharge hole 341*d*. By the discharge hole 341*d*, the pressure in the oil storage chamber 341*a* is made equal to refrigerant pressure in the discharge chamber 346. In the present invention, the oil storage chamber 341*a* corresponds to a discharge area of the compressor 130 in the present invention.

The oil storage chamber 341*a* is for storing therein lubrication oil separated from the refrigerant, and includes a centrifugal separator 360 for separating lubrication oil from refrigerant. The centrifugal separator 360 is a funnel-shaped member extending to a lower side. An outer periphery of a large diameter portion of the centrifugal separator 360 contacts an inner wall of the oil storage chamber 341*a*, and is fixed thereto at a position higher than the discharge hole 341*d*. A discharge port 341*b* is provided in a side wall 341*e* of the oil storage chamber 341*a* at a position higher than the centrifugal separator 360, and is opened toward the condenser 210 of the refrigerant cycle system 200. The discharge port 341*b* and the discharge hole 341*d* communicate with each other through an inner space of the centrifugal separator 360. A first decompression communication passage 371 is provided at a lower side position in the oil storage chamber 341*a* and the motor housing 331. The oil storage chamber 341*a* communicates with the inner space of the motor housing 331 through the first decompression communication passage 371 while the pressure in the oil storage chamber 341*a* is reduced by the first decompression communication passage 371 using its orifice effect with a small diameter. In the present invention, the first decompression communication passage 371 corresponds to an oil introducing passage.

Next, operation of the hybrid compressor having the above structure according to the fifth embodiment will be described. As described in the first and second embodiments, the rotational speed of the compressor 130 is increased and decreased by adjusting the rotational speed of the motor 120 and the rotational direction of the motor 120 with respect to the rotational speed of the pulley 110.

When the compressor 130 is operated, refrigerant is sucked into the motor housing 331 from the suction port 331*a*, and flows through around the motor 120 and around the planetary gear 150. Then, the refrigerant flows into the suction chamber 347 from the suction port 372*a*, and is compressed by the scrolls 343, 344 toward a center of the compression chamber 345. The compressed refrigerant flows into the discharge chamber 346 from the discharge port 344*a*, and reaches the centrifugal separator 360 from the discharge hole 341*d*. At this time, a sliding portion such as the scrolls 135, 344 and the eccentric shaft 134 is lubricated with lubrication oil contained in the refrigerant. The compressed refrigerant passes through the discharge hole 341*d* while its flow speed is increased, and spirally flows to a lower side of the centrifugal separator 360. Since lubrication oil contained in refrigerant has larger specific gravity than refrigerant, the lubrication oil is separated from the refrigerant on the side wall of the oil storage chamber 341*a*, and is stored in the oil storage chamber 341*a* at the lower side. The refrigerant separated from the lubrication oil, flows through the inner space of the centrifugal separator 360, and flows outside of the compressor 130 from the discharge port 341*b*.

The lubrication oil, stored in the oil storage chamber 341*a* at the lower side, is introduced into the motor housing 331 from the first decompression communication passage 371 due to the refrigerant pressure in the oil storage chamber 341*a*, that is, compressed pressure of refrigerant. The introduced lubrication oil is stored in the motor housing 331 until the top end of the storage wall 331*b* in maximum, at lower side positions of the motor 120 and an engagement portion between the pinion gears 152*a* and the ring gear 153. Further, since the pressure in the motor housing 331 is lower than that in the oil storage chamber 341*a*, refrigerant contained in the lubrication oil is boiled in the motor housing 331. Therefore, the lubrication oil, having the refrigerant, is splashed onto the motor 120 and the planetary gear 150. When a liquid surface of the lubrication oil exceeds the top end of the storage wall 331*b*, the lubrication oil flows into the suction chamber 347 from the suction port 372*a* disposed lower than the top end of the storage wall 331*b*, so that the scrolls 135, 344 and the eccentric shaft 134 are lubricated.

As described above, in the fifth embodiment, lubrication oil contained in refrigerant is separated from the refrigerant by the centrifugal separator 360 in the oil storage chamber 341*a*, and the separated lubrication oil is introduced into the motor housing 331 through the first decompression communication passage 371. Then, the introduced lubrication oil is circulated from the motor housing 331 into the suction chamber 347 of the compressor 130. Therefore, lubrication oil can be always supplied to the planetary gear 150 in the motor housing 331, thereby improving reliability of the planetary gear 150. Further, since the motor 120 is also disposed in the motor housing 331, the motor 120 can be cooled by the lubrication oil, thereby improving reliability of the motor 120. Furthermore, the sizes of the planetary gear 150 and the motor 120 can be reduced in place of improving the reliability of the planetary gear 150 and the motor 120.

Since lubrication oil is separated from refrigerant by the centrifugal separator 360, refrigerant, circulated in the refrigerant cycle system 200, contains almost no lubrication oil. Therefore, lubrication oil is not adhered to the heat exchanger such as the evaporator 230 provided in the refrigerant cycle system 200, thereby preventing heat-exchange efficiency in the evaporator 230 from being reduced due to the lubrication oil. Further, since the suction port 331*a* is provided in the motor housing 331, the planetary gear 150 and the motor 120 can be effectively cooled by low-temperature refrigerant before being compressed, thereby further improving the reliability of the motor 120 and the planetary gear 150. Since the oil storage chamber 341*a* and the space in the motor housing 331 communicate with each other through the first decompression communication passage 371, the separated lubrication oil can be introduced into the motor housing 331 by the discharge pressure of refrigerant while it can prevent a large amount of the compressed refrigerant from returning to the motor housing 331.

Because the storage wall 331*b* is provided in the motor housing 331, the liquid surface of lubrication oil is maintained higher than the engagement portion between the pinion gears 152*a* and the ring gear 153 of the planetary gear 150. Therefore, the lubrication oil can be sufficiently supplied to the planetary gear 150 while the planetary gear 150 operates, and the planetary gear 150 can be surely lubricated. The lubrication oil, exceeding the top end of the storage wall 331*b*, is returned again to the compressor 130 through the suction port 372*a*.

When the hybrid compressor 101 is not used, its temperature is reduced, and refrigerant is condensed in the motor housing 331 or in the compressor 130. Then, lubrication oil in the motor housing 331 or the compressor 130 may be over flowed from the suction port 331*a* together with the condensed refrigerant. However, since the check valve 380 is provided in the suction port 331*a*, the lubrication oil is not overflowed from the suction port 331*a* together with the condensed refrigerant. Therefore, the hybrid compressor 101 is not restarted while the lubrication is not supplied to the planetary gear 150 and the compressor 130, thereby preventing troubles of the hybrid compressor 101 such as the lock of the planetary gear 150 and the lock of the compressor 130 from being caused.

Further, the compressor 130 is a scroll type compressor, and the motor housing 331 and the discharge port 341*b* are provided at both end sides of the compression portion of the compressor 130 in the axial direction of the compressor rotational shaft 131. Therefore, the hybrid compressor 101 can be readily constructed. Further, an another suction port directly communicating with the suction chamber 347 may be provided in addition to the suction port 331*a* provided in the motor housing 331. When the suction port 331*a* is provided only in the motor housing 331, refrigerant receives heat from the planetary gear 150 and the motor 120. Therefore, the temperature of refrigerant is increased, refrigerant may be expanded. When the expanded refrigerant is compressed by the compressor 130, compression efficiency of the compressor 130 is reduced. Therefore, if the suction ports 331*a* are provided on both of the motor housing 331 and a housing of the compressor 130, it can restrict the refrigerant expansion while the planetary gear 150 and the motor 120 can be cooled. Even in the fifth embodiment, the rotation speed of the compressor 130 can be changed by the adjustment of the rotation speed of the motor 120 relative to the rotation speed of the pulley 110. In the fifth embodiment, the compressor 130 can be also provided within the motor housing 331.

(Sixth Embodiment)

Figure 16:
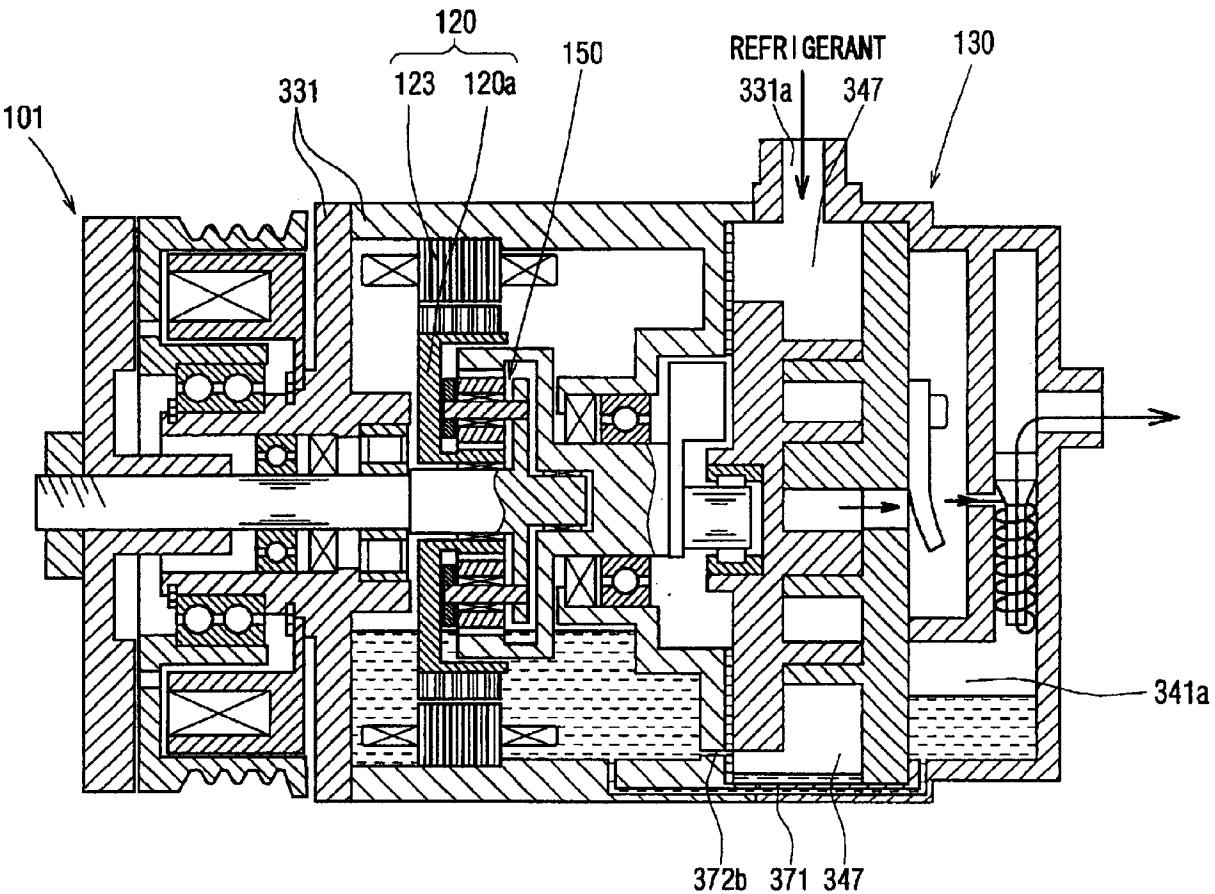
FIG. 16 is a cross-sectional view showing a hybrid compressor according to a sixth embodiment of the present invention.

The sixth embodiment of the present invention will be now described with reference to FIG. 16. In the sixth embodiment, a second decompression communication passage 372*b* is provided in place of the suction port 372*a* described in the fifth embodiment. Specifically, the suction port 331*a* is provided to directly communicate with the suction chamber 347, but the suction port 372*a*, the storage wall 331*b* and the opening hole 331*e* shown in FIG. 15 are eliminated. That is, the space in the motor housing 331 is isolated from the compressor 130.

The second decompression communication passage 372*b* is provided as a communication passage for making the inner space of the motor housing 331 and the suction chamber 347 of the compressor 130 communicate with each other. The second decompression communication passage 372*b* has a predetermined small diameter as in the first decompression communication passage 371. The inner space of the motor housing 331 is made to communicate with the suction chamber 347 through the second decompression communication passage 372*b* while the refrigerant pressure in the motor housing 331 is reduced in the second decompression communication passage 372*b* due to orifice effect. Thus, by the first and second decompression communication passages 371, 372*b*, the pressure is reduced, in order, in the oil storage chamber 341*a*, in the motor housing 331 and in the suction chamber 347. That is, refrigerant in the motor housing 331 is set to a pressure between suction pressure in the suction chamber 347 and discharge pressure in the oil storage chamber 341*a*. Accordingly, lubrication oil can be smoothly circulated in the oil storage chamber 341*a*, the motor housing 331 and the suction chamber 347. Therefore, the lubrication oil can be sufficiently supplied to the planetary gear 150 and the motor 120, so that the planetary gear 150 and the motor 120 are lubricated and cooled by the lubrication oil, thereby improving the reliability of the planetary gear 150 and the motor 120. In the sixth embodiment, the other parts are similar to those of the above-described fifth embodiment.

(Other Embodiments)

A planetary roller or a differential gear may be used in place of the planetary gear 150 in the above-described embodiments. Connection between the planetary gear 150 and the pulley 110, the motor 120 and the compressor 130 may be performed by using other connection structure without being limited to the connection structure in the above-described embodiments. In the present invention, when the driving torque of the pulley 110 and the driving torque of the motor 120 are added, and the added driving torque is transmitted to the compressor 130, the connection structure can be suitably changed. For example, the motor 120 can be connected to the sun gear 151, and the pulley rotational shaft 111 can be connected to the ring gear 153. In this case, the compressor rotational shaft 131 is connected to the planetary carriers 152.

In the fixed displacement compressor, the compressor 130 may be a piston type compressor or a through vane type compressor without being limited to the scroll type compressor. Further, the compressor 130 may be a variable displacement compressor such as a swash plate type compressor, in place of the fixed displacement compressor. In this case, a variable discharge amount of the compressor 130 can be further increased. The present invention can be applied to a hybrid vehicle including a driving motor for driving the vehicle, where the vehicle engine 10 is stopped in a predetermined running condition of the vehicle.

While the present invention has been shown and described with reference to the foregoing preferred embodiments, it will be apparent to those skilled in the art that changes in form and detail may be made therein without departing from the scope of the invention as defined in the appended claims.

What is claimed with:

1. A hybrid compressor device comprising:

a driving unit rotated by receiving driving force from an outside driving source;

a motor rotated by receiving electric power from an outside power source;

a compressor operated by at least one of the driving unit and the motor, the compressor being for compressing refrigerant in a refrigerant cycle system, the compressor including a suction area into which refrigerant before being compressed is introduced, a discharge area into which compressed refrigerant flows, and an oil separating unit for separating lubrication oil contained in refrigerant from the refrigerant and for storing the separated lubrication oil in the discharge area;

a transmission mechanism disposed between the compressor and at least any one of the driving unit and the motor, the transmission mechanism being for changing a rotational speed of the at least one of the driving unit and the motor, to be transmitted to the compressor;

a housing for accommodating therein the motor and the transmission mechanism; and means for forming an oil introducing passage through which the lubrication oil stored in the discharge area is introduced into the housing, wherein an inner space of the housing communicates with the suction area through a communication passage.

2. The hybrid compressor device according to claim 1, wherein:

at least one of the compressor and the housing has a suction port from which the refrigerant is introduced into the suction area of the compressor.

3. The hybrid compressor device according to claim 1, wherein:

the housing is disposed to accommodate the compressor, the motor and the transmission mechanism; and the housing has a suction port, from which the refrigerant is sucked into the compressor, at a side where the motor and the transmission mechanism are disposed.

4. The hybrid compressor device according to claim 1, wherein:

the oil introduction passage is a decompression passage through which the discharge area communicates with the inner space of the housing while a pressure from the discharge area is reduced in the communication passage.

5. The hybrid compressor device according to claim 1, wherein:

the transmission mechanism includes a plurality of movable members;

the housing has a storage wall for storing a predetermined amount of the lubrication oil in the housing;

the storage wall has a top end at a position higher than a contact portion between the movable portions; and the communication passage is provided at a position lower than the top end of the storage wall.

6. The hybrid compressor device according to claim 1, wherein the oil introduction passage is a first decompression passage through which the discharge area communicates with the inside of the housing while pressure is reduced from the discharge area toward the inside of the housing; and the communication passage is a second decompression passage through which the inside of the housing communicates with the suction area while pressure is reduced from the inside of the housing toward the suction area.

7. The hybrid compressor device according to claim 1, wherein the lubrication-oil separating unit is a centrifugal separator disposed in the discharge area.

8. The hybrid compressor device according to claim 2, further comprising a check valve provided in the suction port, for preventing the lubrication oil from flowing out from the housing through the suction port.

9. The hybrid compressor device according to claim 1, wherein:

the compressor includes a compression portion for compressing refrigerant, and a discharge port from which compressed refrigerant is discharged outside the compressor; and the housing and the discharge port are provided at both sides of the compression portion in a rotational axial direction of the compressor.

* * * * *